US005761933A

United States Patent [19]

Kim et al.

[11] Patent Number: 5,761,933

[45] Date of Patent: Jun. 9, 1998

[54] CLOTHES WASHER WITH BALANCING DEVICES FOR DYNAMICALLY COUNTERACTING IMBALANCES

[75] Inventors: Do Weon Kim, Seoul; Sung Jae Shin, Suwon, both of Rep. of Korea

[73] Assignee: Samsung Electronics Co., Ltd., Suwon, Rep. of Korea

[21] Appl. No.: 708,504

[22] Filed: Sep. 5, 1996

[30] Foreign Application Priority Data

| | | | |
|---|---|---|---|
| Sep. 6, 1995 | [KR] | Rep. of Korea | 95-29179 |
| Sep. 25, 1995 | [KR] | Rep. of Korea | 95-25971 |
| Dec. 6, 1995 | [KR] | Rep. of Korea | 95-47118 |

[51] Int. Cl.[6] ..... D06F 37/24

[52] U.S. Cl. ..... 68/23.2; 74/573 F

[58] Field of Search ..... 68/23.2; 210/144, 210/363, 364; 74/573 F, 573 R

[56] References Cited

U.S. PATENT DOCUMENTS

| | | | |
|---|---|---|---|
| 2,549,756 | 4/1951 | Clark | 74/573 F X |
| 5,345,792 | 9/1994 | Farrington et al. | 68/23.2 |

FOREIGN PATENT DOCUMENTS

| | | | |
|---|---|---|---|
| 62977 | 5/1977 | Japan | 68/23.2 |
| 40998 | 2/1992 | Japan | 68/23.2 |
| 122387 | 4/1992 | Japan | 68/23.2 |

*Primary Examiner*—Philip R. Coe

*Attorney, Agent, or Firm*—Burns, Doane, Swecker & Mathis, L.L.P.

[57] ABSTRACT

A clothes washing machine has a spin basket with upper and lower balancing devices respectively disposed on upper and lower parts of the spin basket. The lower balancing device has a liquid such as a saline solution occupying the interior thereof. The lower balancing device includes an upper body integrally formed on the spin basket, and a lower body joined to the upper body. At least one of the bodies includes radially spaced concentric ribs that form annular chambers. Liquid is disposed in each chamber, and possibly also movable balls are disposed in each chamber.

14 Claims, 12 Drawing Sheets

Fig. 5A
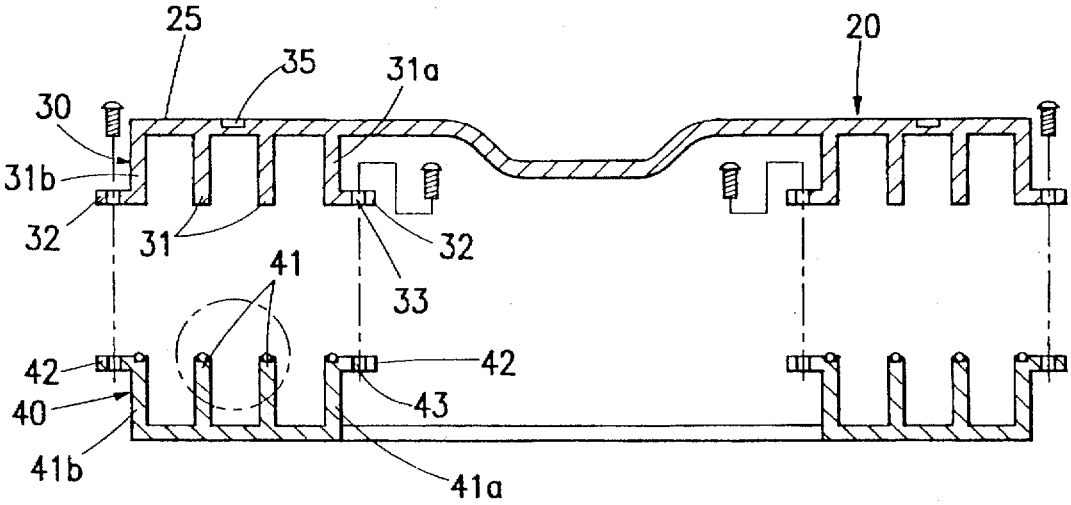
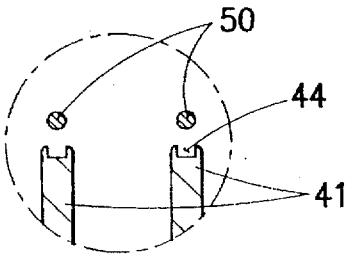
Fig. 5B

Fig. 7A
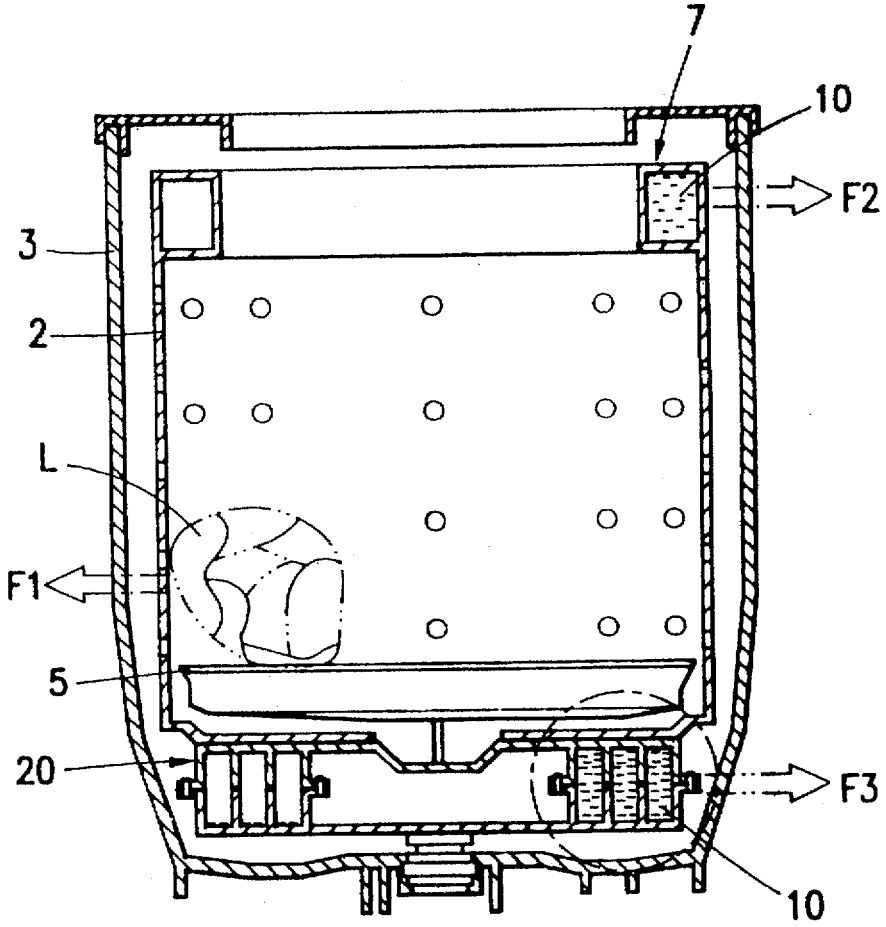
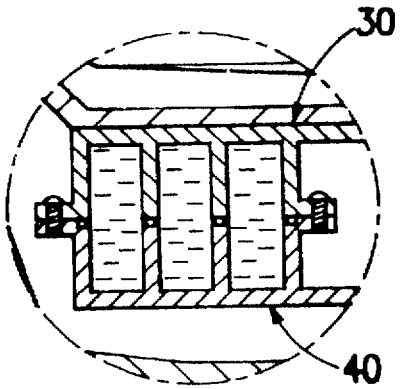
Fig. 7B

CLOTHES WASHER WITH BALANCING DEVICES FOR DYNAMICALLY COUNTERACTING IMBALANCES

BACKGROUND OF THE INVENTION

1. Field of the Invention

The present invention relates to a clothes washing machine. More particularly, it relates to a washing machine which has an improved unbalance compensating function by providing balancing devices for dynamically counteracting imbalances 2. Discussion of Related Art FIG. 10 depicts a longitudinal sectional view of a washing machine equipped with a conventional balancing device.

The washing machine includes a spin basket 2 and a fixed basket 3 disposed inside of a main body 1. The spin basket 2 has a number of drain holes on its surface and serves as a hydro-extracting (spin dry) member. The fixed basket 3 is mounted outside of the spin basket 2 and serves as a container for containing water. The fixed basket 3 is supported by suspension arms 4 fixed to the top of the main body 1. The washing machine also includes a pulsator 5 which is located on the bottom of the spin basket 2, a driving unit 6 that is installed under the spin basket 2 so as to rotate the spin basket 2 and the pulsator 5.

In such a washing machine, laundering is performed by the action of detergent and water put into the washing machine and water current generated by the rotation of the pulsator 5, and dehydrating is performed by centrifugal force applied during spinning of the spin basket 2 so as to leave the clothes with just enough moisture for ironing. Full automatic washing machines have a microcomputer that is programmed to automatically execute the overall laundering process such as the water filling, washing, rinsing, draining and dehydrating.

When the spin basket 2 rotates at high speeds so as to extract excess moisture from the wet laundry in a condition that the laundry has gathered only at one side of the spin basket 2, its center of gravity deviates from the center of rotation, which causes the spin basket 2 to be in an out-of-balance state. The out-of-balance spin basket 2 results in excessive amounts of vibration and noise which increase the possibility of damaging; the components of the washing machine.

A balancing device 7 containing liquid is installed on the upper part of the spin basket 2 in order to keep the dynamic balance of the spin basket 2. The balancing device 7 includes a ring-shaped case formed by joining upper and lower parts together by thermal bonding, and a saline solution 10 that is filled up to 50% in the case to counteract the imbalance.

According to the conventional washing machine, because the balancing device 7 is installed just on the upper part of the spin basket 2, it does not effectively offset unbalanced forces when a large amount of the laundry inside the spin basket 2 is concentrated at one side of the center of rotation.

To explain it more specifically, referring to FIG. 11, when the spin basket 2 begins to rotate at high speeds in order to extract excessive moisture from the laundry L concentrated into one spot within the spin basket 2, the saline solution 10 flows to the opposite side of the laundry. When the eccentricity of the laundry L in the spin basket 2, however, is too great compared with the single balancing device 7 to counteract it, the out-of-balance condition of the spin basket 2 cannot be properly corrected by the movement of the saline solution 10. In other words, because the centrifugal force F1 of the laundry L situated to one side is larger than the centrifugal force F2 of the saline solution 10 that serves to balance the out-of-balancing spin basket 2, the basket 2 does not tend to revolve on the geometric axis 0 but turns around the axis of rotation 0' leaning towards where the laundry L is located.

Accordingly, as the axis of rotation 0' revolves around the geometric axis 0 in direction R' in FIG. 11, the spin basket 2 is out-of-balance, and collides with the integrated components resulting in excessive noise and vibration.

Besides, a moment M1 resulting from the weight of the laundry L is larger than an opposite moment M2 resulting from the saline solution 10 in the spin basket 2 to generate rotating forces acting to left and right. Imbalanced force and moment are then applied to the spin basket 2 which makes noise.

In conclusion, if the spin basket of a washing machine with the conventional balancing device begins to rotate to remove excess moisture from wet laundry while a large amount of the laundry is situated to one side therein, dynamic forces and moments on the washing machine are unbalanced which cause the machine to vibrate thereby creating noise and damage to its mechanism. Accordingly, the conventional balancing device is inadequate for washing machines with a large hydro-extracting capacity.

SUMMARY OF THE INVENTION

Accordingly, the present invention is applied to a washing machine obviate one or more of the problems due to limitations and disadvantages of the related art.

It is an object of the present invention to provide a washing machine having balancing devices formed on the upper and lower parts respectively, of the spin basket for the purpose of enhancing the unbalance compensating operation and hydro-extracting capacity.

It is another object of the present invention to provide a washing machine having balancing devices in which a balancing liquid is filled in a spin basket's large lower part enough to balance the rotating forces and moments acting on the spin basket.

It is still another object of the present invention to provide a washing machine having upper and lower balancing devices of which the lower balancing structure is improved for easy fabrication and for sure prevention against leakage of the balancing liquid contained in the balancing devices.

According to one aspect of the present invention, there is provided a washing machine with a housing, a fixed basket installed in the housing, a spin basket mounted within the fixed basket, and upper and lower balancing devices respectively provided to upper and lower parts of the spin basket. The lower balancing device has a balancing member attached to the periphery of the lower part of the rotating cylinder by thermal bonding, and a liquid filling the interior of the balancing member. The liquid is preferably a saline solution.

According to a further aspect of the present invention, there is provided a washing machine with a lower balancing device having an upper body integrally formed on a bottom cover attached to the lower part of the spin basket, and a lower body joined to the upper body. A plurality of upper ribs are mounted concentric to the axis of rotation and extend downward from the lower part of the upper body, and a plurality of lower ribs are formed concentric to the axis and extend upward from the upper part of the lower body. Each of the innermost and outermost ribs has flanges extending axially and having screw holes, and the upper and lower bodies are joined together by screws through the screw holes. The lower ribs respectively have grooves on the tops and seal rings are inserted into the grooves so that the upper ribs are joined to the corresponding lower ribs with the seals for forming a seal.

According to a yet further aspect of the present invention, there is provided a washing machine with a lower body having a plurality of ribs formed concentric to its axis and extending upward on the upper part of the lower body, and an upper body having grooves which the ribs are fitted into on the lower part of the upper body. The outermost groove of the upper body and the outermost rib of the lower body have a plurality of screw holes on their respective sides so that the upper and lower bodies are joined together by screws through the screw holes. Of the spaces between the ribs, the innermost space is the smallest of all and the outermost space is the largest, and different sized tracks are formed by adjacent ribs. A liquid is contained in each track to dynamically counterbalance an out-of-balance spin basket. In addition, a plurality of different sized balls are movably located in the respective tracks, with the ball size corresponding to the track size.

It is to be understood that both the foregoing general description and the following detailed description are exemplary and explanatory, which are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings:

Figure 2:
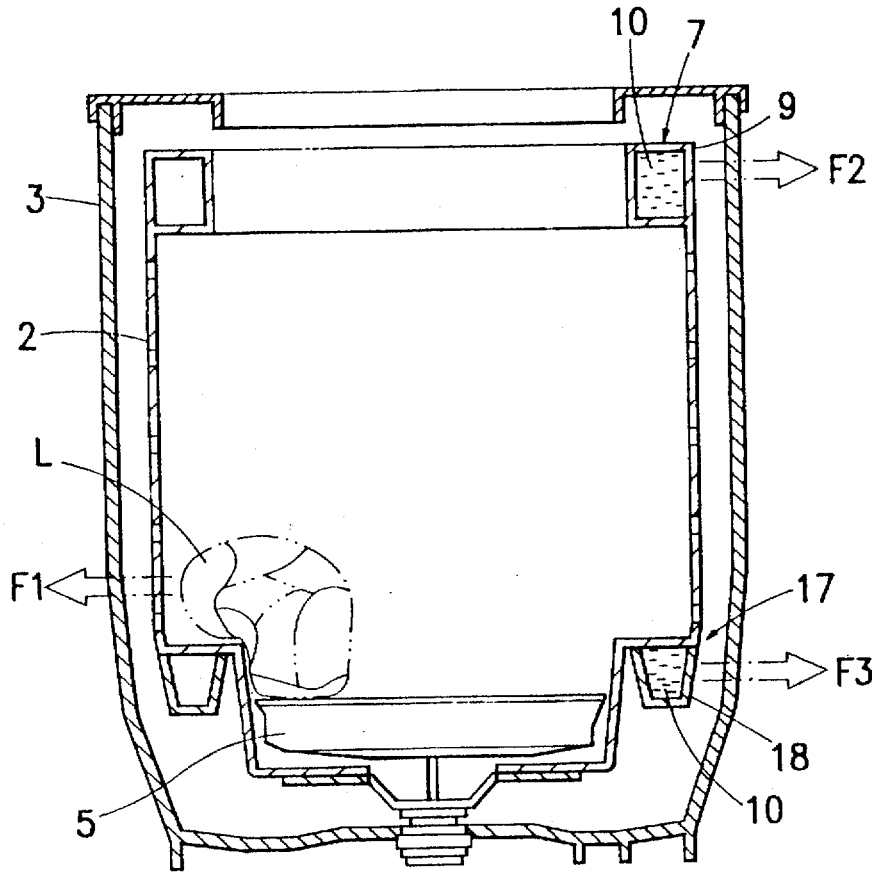
FIG. 2 is a view for illustrating the direction of centrifugal force F1 acting on laundry situated to one side in a spin basket and centrifugal forces F2 acting on the balancing devices in accordance with the first preferred embodiment of the present invention.
Figure 3A:
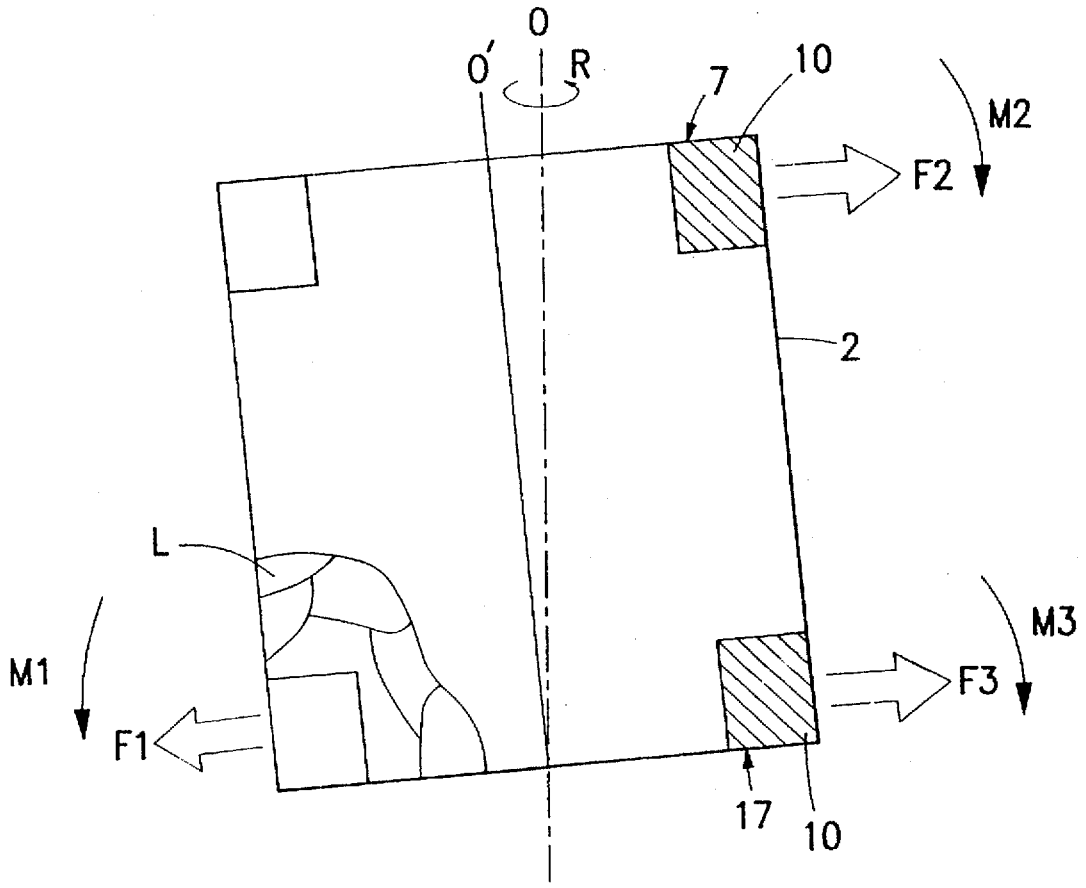
Figure 3B:
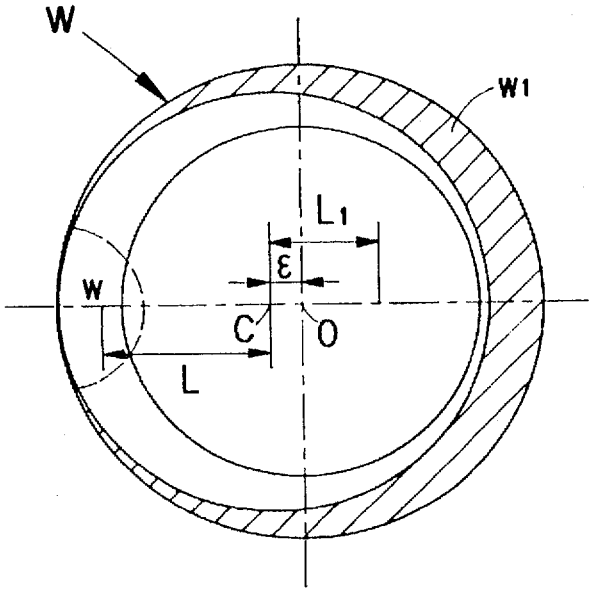
Figure 3C:
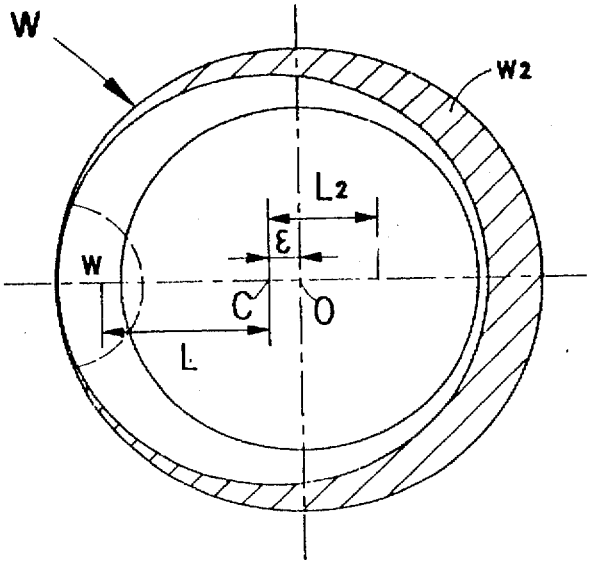
Figure 4:
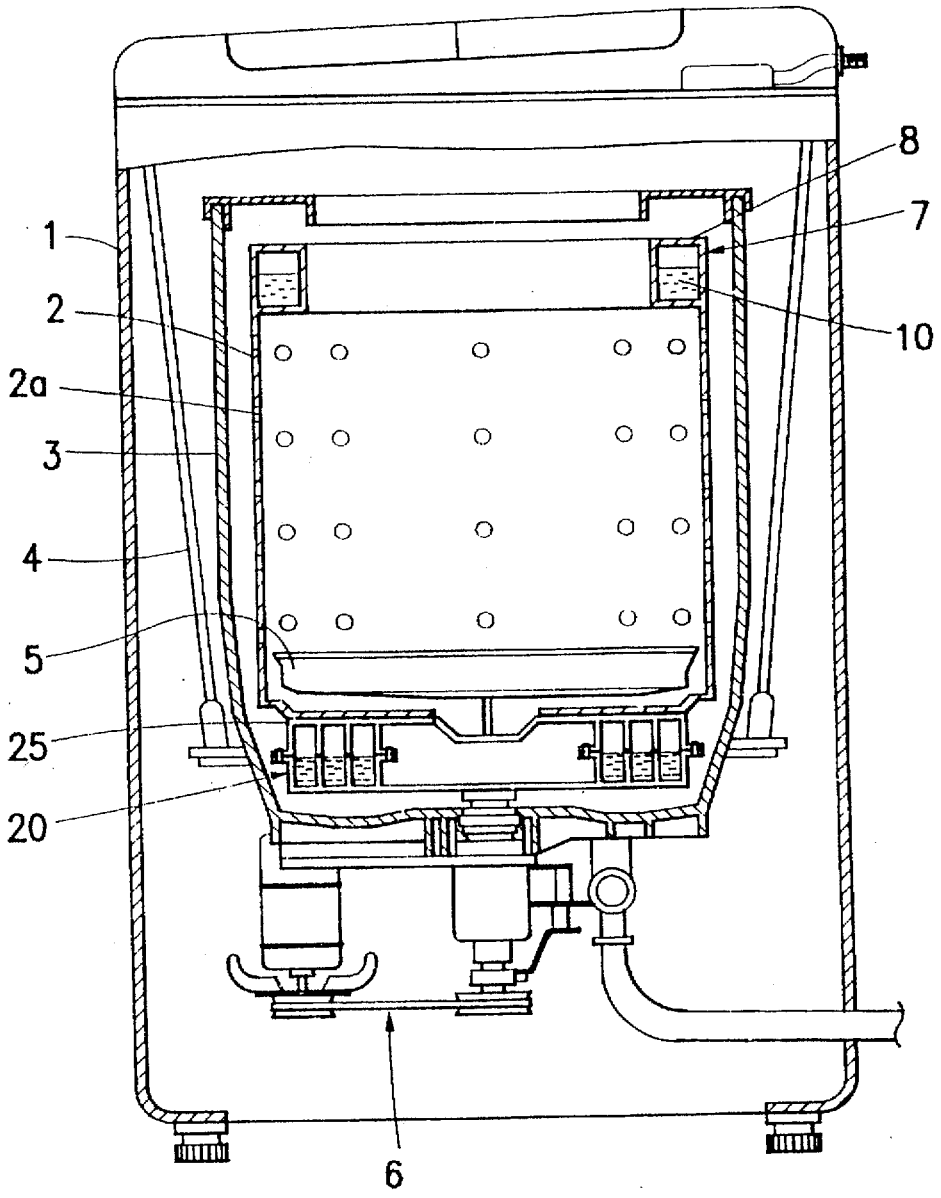
Figure 6:
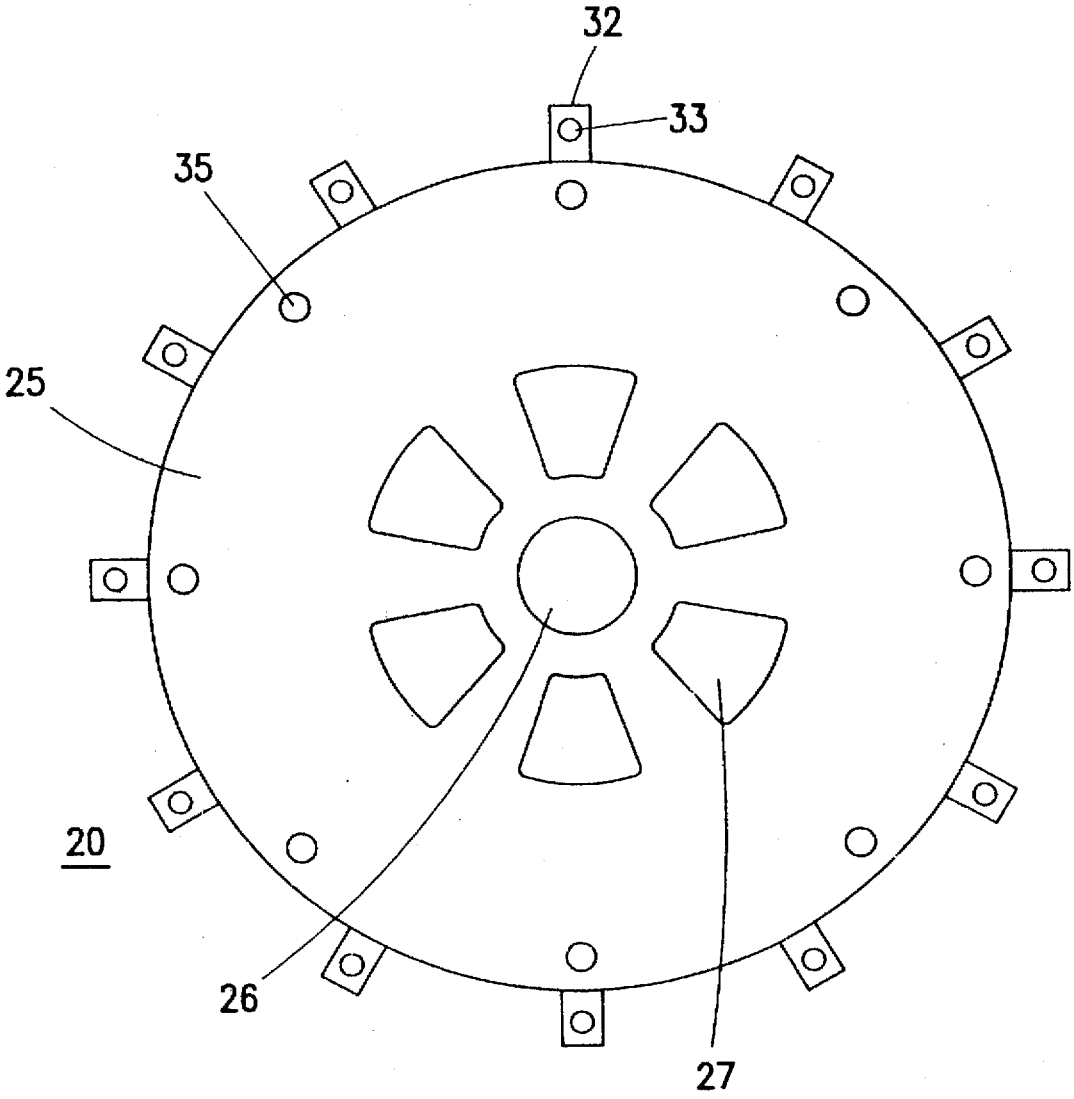
Figure 8:
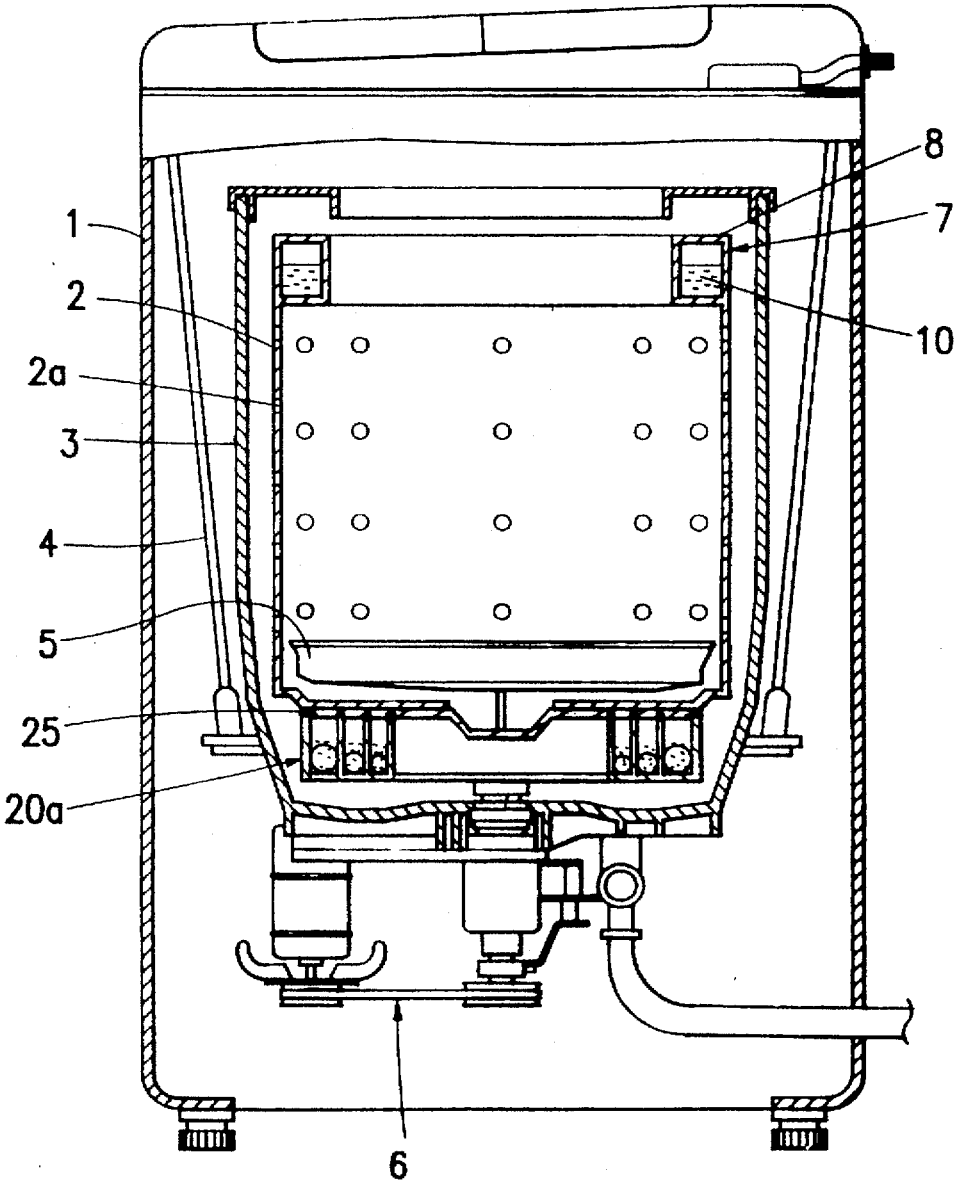
Figure 9A:
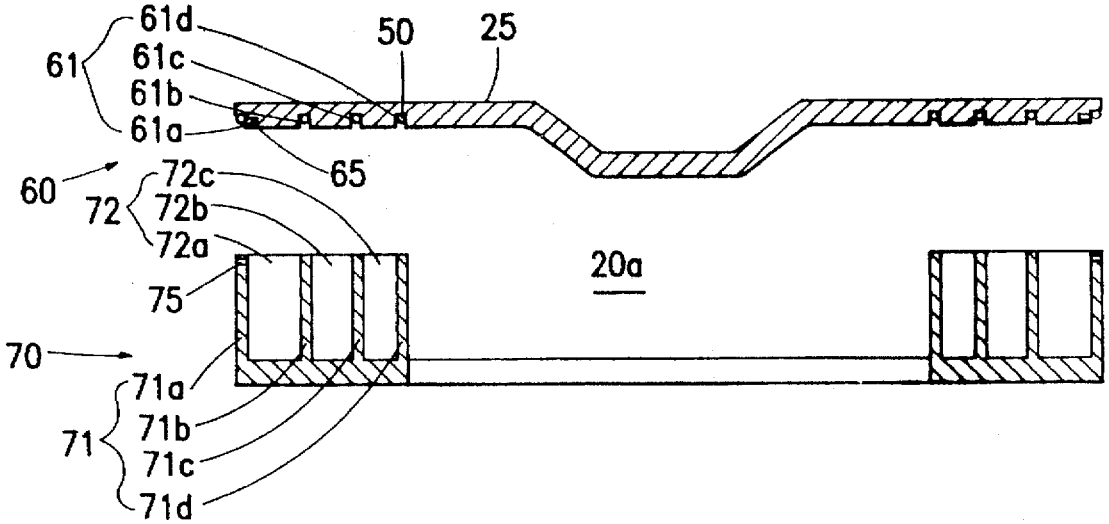
Figure 9B:
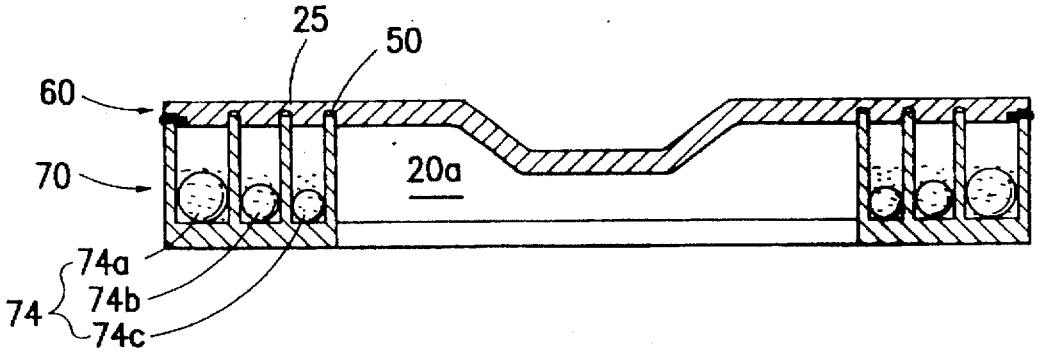
Figure 10:
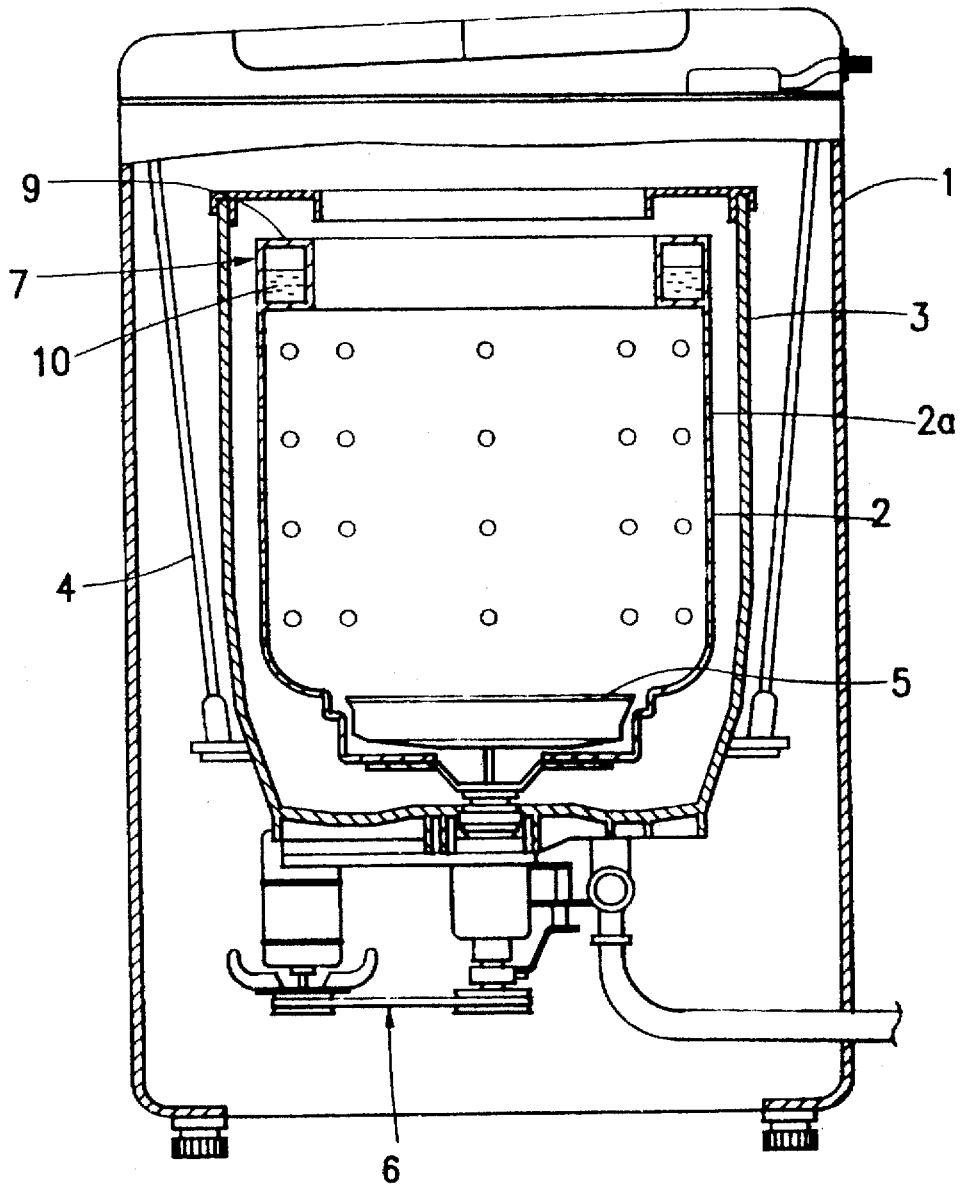
Fig. 10 (Prior Art)
Figure 11:
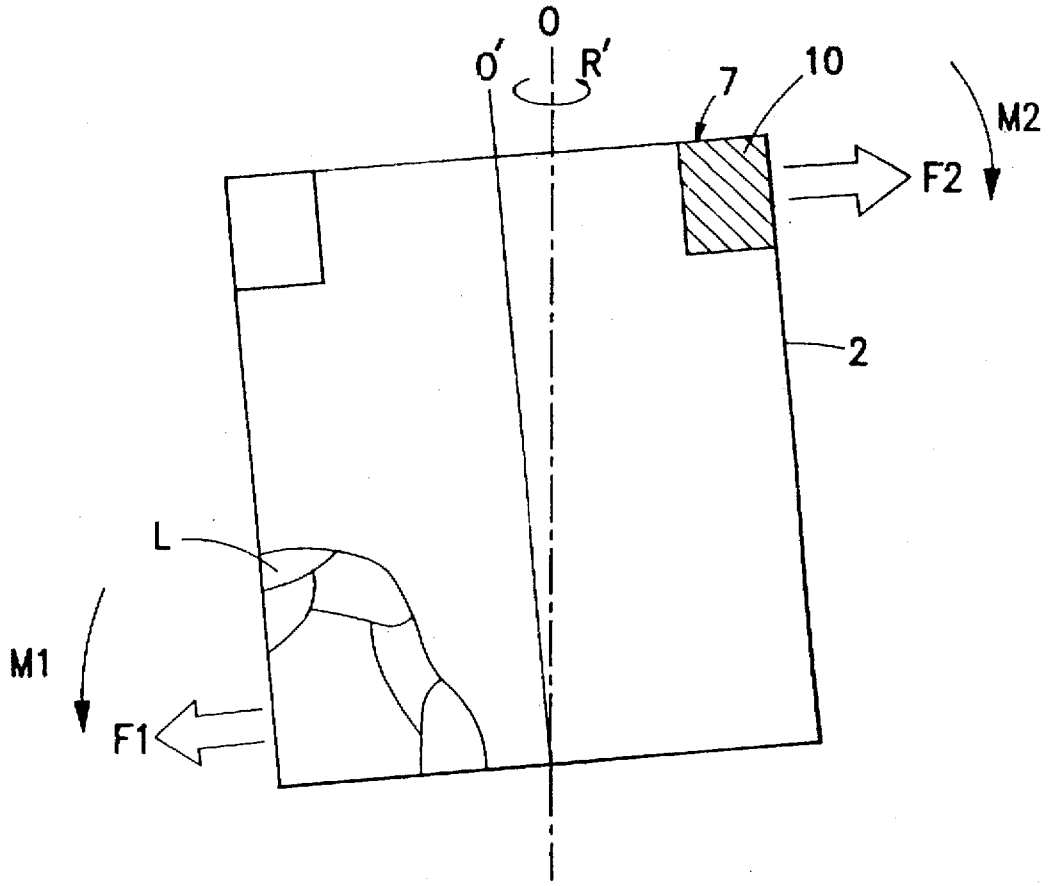
Fig. 11 (Prior Art)

FIGS. 3A, 3B and 3C schematically depict a balancing of moments by the action of the forces of FIG. 2;

FIG. 4 depicts a longitudinally-sectional view of a washing machine with balancing devices in accordance with a second preferred embodiment of the present invention;

FIG. 5A depicts an exploded-sectional view of the low balancing device shown in FIG. 3;

FIG. 5B is an enlarged fragmentary view of FIG. 5A;

FIG. 6 depicts a plan view of the upper body of the lower balancing device shown in FIG. 4;

FIG. 7A is a view for illustrating the direction of centrifugal force F1 acting on laundry situated to one side in a spin basket and centrifugal forces F2 and F3 acting on the balancing devices in accordance with the second preferred embodiment of the present invention;

FIG. 7B is an enlarged fragmentary view of FIG. 7A;

FIG. 8 depicts a longitudinally-sectional view of a washing machine with balancing devices in accordance with a third preferred embodiment of the present invention;

FIGS. 9A and 9B depict sectional views of the coupling structure of the balancing devices of FIG. 8;

FIG. 10 depicts a longitudinally-sectional view of a washing machine equipped with a conventional balancing device; and FIG. 11 is a view for illustrating the direction of centrifugal force F1 of laundry and centrifugal force F2 of the balancing device of FIG. 10.

DETAILED DESCRIPTION OF PREFERRED EMBODIMENTS

Reference will now be made in detail to the preferred embodiments of the present invention, examples of which are illustrated in the accompanying drawings.

Figure 1:
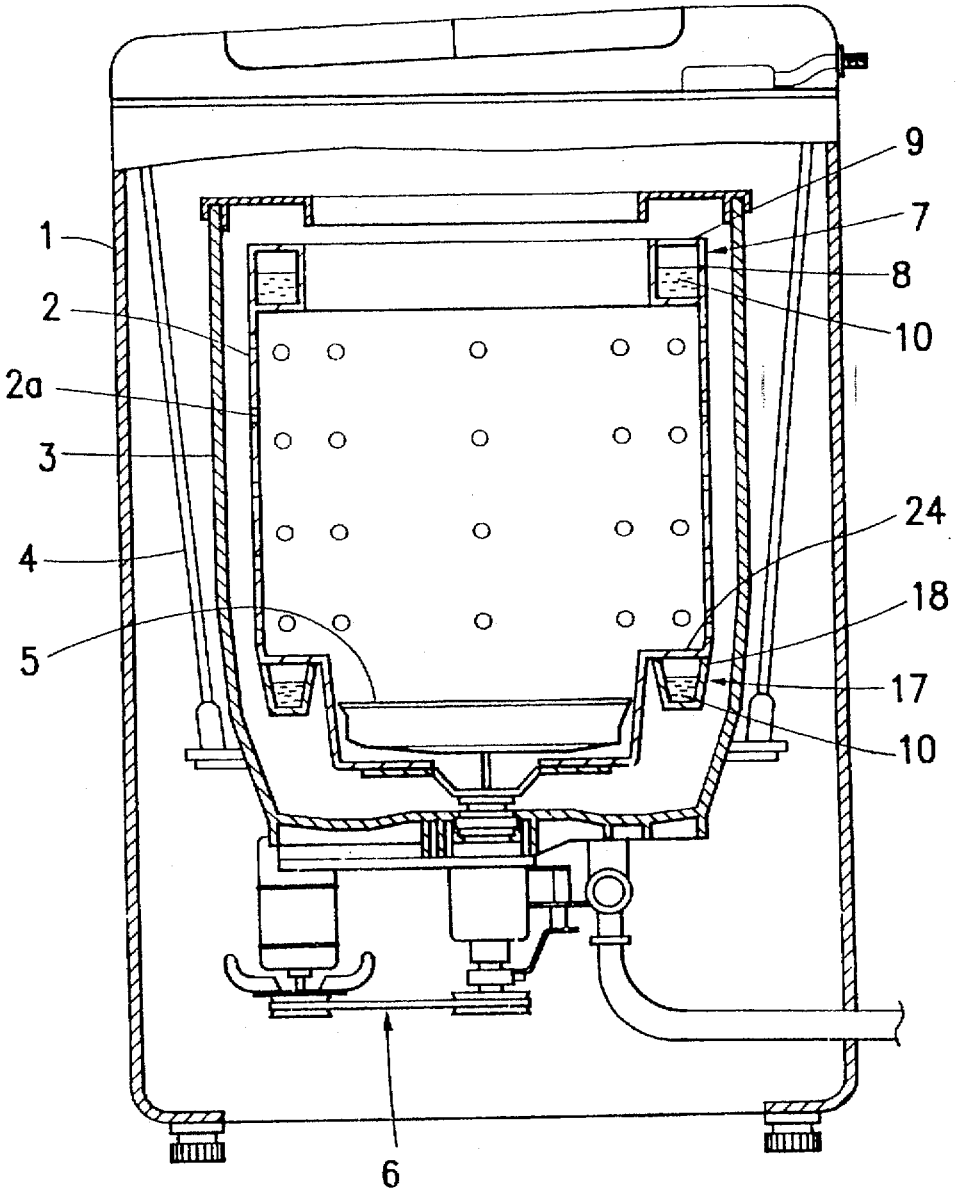
FIG. 1 depicts a longitudinally-sectional view of a washing machine with balancing devices in accordance with a first preferred embodiment of the present invention.

As shown in FIG. 1, the construction of the washing machine is similar to that of FIG. 10, except for the balancing device. Thus, redundant descriptions of features common to the conventional system and the preferred embodiments of the present invention are omitted.

The first preferred embodiment of the present invention has a feature that balancing devices 7 and 17 for dynamically balancing a spin basket 2 are respectively provided at the upper and lower parts of the spin basket 2.

The upper balancing device 7 is formed to be the same as a conventional one. The upper balancing device 7 has a tube 8, a cover 9 bonded to the upper section of the tube 8, and a saline solution 10 substantially filling 50% of the tube 8.

The lower balancing device 17 is formed on the periphery of the lower part of the spin basket 2. The lower balancing device 17 is sealed up not by using a secondary cover but by thermally attaching its tube 18 to the lower part of the spin basket 2, and a saline solution 10 fills substantially half of the tube 18. The spin basket 2 and tubes 8 and 18 of the present invention can be formed by slightly modifying the conventional ones. In case that the periphery of the lower part of the spin basket 2 is not flat, a flat sheet 24 is provided thereto so that a conventional tube can be sealed up without any gap being created.

In this washing machine, laundering is performed by the actions of detergent and water put into the washing machine and water current created by the low-speed rotation of the pulsator 5, and excess water can be removed from wet laundry by centrifugal force acting on the spin basket 2 to thereby leave the wash with just enough moisture for ironing.

The counterbalancing action of the inventive balancing devices at the time of hydro-extraction will be described as follows with reference to the embodiments of FIGS. 2 and 3.

Referring first to FIG. 2, when the spin basket 2 containing laundry L rotates at high speeds for hydro-extraction, a liquid contained in each of the upper and lower balancing devices 7 and 17 moves to the opposite side of the laundry L.

Centrifugal force F1 produced by the laundry L situated to one side in the spin basket 2 oppositely acts with respect to centrifugal forces F2 and F3 generated by the liquid in the upper balancing devices 7 and 17 so as to keep a balance of the rotating forces acting on the washing machine.

Referring now to FIGS. 3A, 3B and 3C, the balancing of moments is described as follows.

As shown in FIGS. 3B and 3C, the reference numerals denote the following: w the weight of the laundry gathered; W the weight of the spin basket; O the center of gravity of the spin basket 2; $\epsilon$ the offset distance between the center of gravity O of the spin basket 2 and the center of rotation C; L the distance between the center of gravity of the laundry and the center of rotation C; $w_1$ the weight of the saline solution 10 of the upper balancing device 7; $L_1$ the distance between the center of gravity of the saline solution 10 in the upper balancing device 7 and the center of rotation C; $w_2$ the weight of the saline solution 10 of the lower balancing device 17; and $L_2$ the distance between the center of gravity of the saline solution 10 in the lower balancing device 17 and the center of rotation C.

The balancing of moments is achieved when the following equation is satisfied:

$$wL=(\epsilon \cdot W)+(w_1 \cdot L_1)+(w_2 \cdot L_2)$$

On the contrary, a conventional washing machine includes a balancing device formed just on an upper part of a spin basket and achieves a less effective counterbalancing action. Such a conventional washing machine can be in a perfect balance condition provided the following equation is satisfied:

$$wL=(\epsilon \cdot W)+(w_1 \cdot L_1)$$

The inventive washing machine has a counterbalancing capacity increased by $w_2$ and $L_2$ as compared to the conventional machine. In other words, the eccentricity can be compensated by the moment $(w_2 \cdot L_2)$ in the washing machine of the present invention whereby the overall counterbalancing capacity is increased.

Accordingly, the axis of rotation is corrected to the geometric axis O by the upper and lower balancing devices 7 and 17 so that the spin basket 2 can turn without vibration, despite the gathered laundry L.

FIGS. 4 to 7 relate to a second preferred embodiment of the present invention.

According to the second preferred embodiment of the present invention, a lower balancing device 20 may have an increased capacity for containing a liquid and is designed to be of a superior construction than that of the first preferred embodiment so as to facilitate its fabrication.

Likewise, the second preferred embodiment includes upper and lower balancing devices 7 and 20 respectively provided to upper and lower parts of a spin basket 2, as shown in FIG. 4. The lower balancing device 20 is integrally mounted on a bottom cover 25 of the spin basket 2.

The second embodiment of the present invention is featured by the construction of the lower balancing device 20 depicted in detail in FIG. 5. The lower balancing device 20 includes upper and lower bodies 30 and 40 that are made of aluminum by die-casting.

The upper body 30 of the lower balancing device 20 is integrally formed on the bottom cover 25 of the spin basket 2. Therefore, the lower balancing device 20 can be more simply fabricated. Particularly, a relatively large space is ensured by the use of the bottom cover 25 so that the lower balancing device 20 may contain a large amount of liquid enough to effectively perform the counterbalancing action. Besides, the large amount of liquid lowers the center of gravity of the spin basket 2, and enables the basket 2 to be little influenced by the imbalances of rotation.

The upper body 30 has on its lower edge a plurality of upper ribs 31, 31*a* and 31*b* extending downward and annularly concentric to the axis of rotation. The lower body 40 includes on its upper edge a plurality of lower ribs 41, 41*a* and 41*b* extending upwards and annularly concentric to the axis of rotation, the ribs 41, 41*a* and 41*b* corresponding to respective ribs 31, 31*a* and 31*b*. The lower balancing device 20 contains a saline solution filling 50% of each of the tracks or chambers formed by the upper and lower ribs coupled to each other.

Each of the inner ribs 31*a* and 41*a* and the outer ribs 31*b* and 41*b* has a laterally extending flange 32 and 42. The flanges 32 and 42 are respectively disposed in circumferentially spaced relationship (se FIG. 6), and have screw holes 33 and 43 so that the upper and lower bodies 30 and 40 are fastened to each other by the use of screws. The lower ribs 41, 41*a* and 41*b* each have one of groove 44 on its top, and rubber rings 50 fit into the grooves 44 so as to prevent the saline solution from leaking between the ribs 31 and 41 when the upper ribs 31, 31*a* and 31*b* and the corresponding lower ribs 41, 41*a* and 41*b* are joined together.

FIG. 6 depicts a plan view of the upper body 30 of the lower balancing device 20 of FIG. 4.

As shown in FIG. 6, a plurality of screw holes 35 are formed in the upper surface of the upper body 30 of the lower balancing device 20 (i.e. on the upper surface of the bottom cover 25) so that the upper body 30 of the lower balancing device 20 can be screwed to the spin basket 2. Reference numeral 26 denotes an opening into which a driving shaft of the pulsator 5 is inserted and reference numeral 27 designates a plurality of drain holes formed in the bottom of the spin basket 2.

The following description concerns the operations of the preferred embodiments of the present invention.

FIG. 7 is a view for showing the balanced state achieved by the upper and lower balancing devices 7 and 20 during the rotation of the spin basket 2.

If the spin basket 2 turns at high speeds in order to extract excess water from laundry L while the laundry L in the spin basket 2 is being situated to the left side in FIG. 7 and is in an out-of-balance condition, the saline solution 10 contained in the upper and lower balancing devices 7 and 20 is concentrated into the right side, i.e. the opposite side of the laundry L by centrifugal force. Thus, the force and moment produced by the laundry L may be offset by the action of the saline solution 10 located on the opposite side of the laundry L so that the spin basket 2 can be in the balanced state. The rest of the second embodiment is similar to the first embodiment, and further descriptions are omitted.

The lower balancing device 20 of the present invention is designed to have a large enough capacity to contain a large amount of the saline solution 10, so even when the amount of the laundry L is large, the balancing of force and moment can be stable. On the contrary, in case that the laundry L is evenly distributed over the interior of the spin basket 2 and the center of gravity is located on the geometric axis O (FIG. 3A), the saline solution 10 is evenly distributed within the upper and lower balancing devices 7 and 20 so that the spin basket 2 can rotate without vibration.

The lower balancing device 20 of the present invention is arranged to be divided into separate tracks or chambers by the ribs 31 and 41, and the counterbalance is separately created in each track so as to balance more stably the out-of-balance spin basket.

FIGS. 8, 9A and 9B refer to a third preferred embodiment of the present invention.

A lower balancing device 20*a* in accordance with the third preferred embodiment, is substantially similar to the second embodiment of this invention. The following description relates to features of the lower balancing device 20*a* of the third preferred embodiment compared to the lower one 20 of the second preferred embodiment.

As shown in FIG. 8, the lower balancing device 20*a* of the third preferred embodiment is also integrally formed on a bottom cover 25 of a spin basket 2.

Referring now to FIG. 9A, the lower balancing device 20*a* includes upper and lower bodies 60 and 70 that are joined to each other. The upper body 60 has a plurality of grooves 61 formed concentric with the axis, spaced radially from each other on the lower surface. The innermost space between the grooves 61*c* and 61*d* is the smallest (narrowest) of all, and the outermost space between the grooves 61*a* and 61*b* is the largest (widest).

The lower body 70 has on the upper surface a plurality of upwardly projecting ribs 71 that are axially formed to correspond to the grooves 61*a*, 61*b*, 61*c* and 61*d*. Seals 50 are respectively interposed between the grooves 61 and the ribs 71 for forming a seal. A plurality of screw holes 65 and 75 are respectively formed along the sides of the outermost groove 61*a* and the outermost rib 71*a*.

The ribs 71*a*, 71*b*, 71*c* and 71*d* of the lower body 70 are fitted into the corresponding grooves 61*a*, 61*b* and 61*c* of the upper body 60 together with the seals 50, and screws are tightened to easily and firmly couple the upper and lower bodies 60 and 70 together.

As shown in FIG. 9B, according to the third preferred embodiment of the present invention employ, a plurality of balls 74 and liquid are provided in the respective tracks 72*a*, 72*b* and 72*c* formed to be different in size by the ribs 71*a*, 71*b*, 71*c* and 71*d*. The balls are designed to be of different sizes corresponding to each track in which the balls are contained. The smallest ball size 74*c* is located in the innermost track 72*c*, and the biggest ball size 74*a* is in the outermost track 72*a*. The different sized balls 74 are moved to the opposite side of the unbalanced laundry so that the imbalances can be removed and a greater magnitude of moment be created.

It is preferable that the balls 74 are made from a relatively heavy metallic material such as steel. The liquid contained in the tracks 72 is preferably an oil 10*a* with high viscosity to reduce the noise made by the balls when the spin basket 2 is in operation.

Therefore, the balls 74 that are situated in their respective tracks 72 together with the oil 10*a* are evenly distributed to carry out a more enhanced balancing movement. Since the operation of the third preferred embodiment is similar to that of the second embodiment, further descriptions are omitted.

As discussed above, the present invention can enhance the effectiveness of the counterbalance by the mutual actions of the upper and lower balancing devices respectively provided to the upper and lower parts of the spin basket so that the vibration of the high-speed spin basket can be more effectively removed.

The lower balancing device is designed to be formed integrally on the bottom cover attached to the lower part of the spin basket, and its components, upper and lower bodies are joined by the simple use of screws thereby facilitating the assembling and ensuring a spacious area necessary for the counterbalance.

Besides, the lower balancing device having a large area is designed to be divided into a plurality of tracks in such a manner that the counterbalancing movement is separately carried out by the liquid contained in each track to maximize the counterbalancing action of the lower balancing device. The tracks containing the oil are of different sizes and the plurality of the different sized balls are located in the corresponding tracks so as to dynamically balance the out-of-balance spin basket.

It will be apparent to those skilled in the art that various modifications and variations can be made in a washing machine with balancing devices of the present invention without departing from the spirit or scope of the invention. Thus, it is intended that the present invention cover the modifications and variations of this invention provided they come within the scope of the appended claims and their equivalents.

What is claimed is:

1. A washing machine comprising a housing, a fixed basket installed in the housing, and a spin basket rotatable around an axis of rotation within the fixed basket, and upper and lower balancing means respectively mounted on upper and lower parts of said spin baskets, wherein said lower balancing means comprises an upper body integrally formed on a bottom cover attached to the lower part of said spin basket, and a lower body joined to the upper body.

2. A washing machine according to claim 1, wherein said lower balancing means comprises a balancing member attached to the periphery of the lower part of the spin basket by thermal bonding, and a liquid occupying an interior of the balancing member.

3. A washing machine according to claim 1, wherein the upper body includes a plurality of upper ribs mounted concentrically to the axis and extending downwardly from a lower part of the upper body, and the lower body includes a plurality of lower ribs mounted concentrically to the axis and extending upwardly from an upper part of the lower body to correspond to the plurality of the upper ribs.

4. A washing machine according to claim 3, wherein the upper and lower ribs include radially innermost and outermost ribs which have radial flanges in which screw holes are formed, and the upper and lower bodies are joined together by screws extending through the screw holes.

5. A washing machine according to claim 3, wherein some of the ribs have grooves on an end face thereof and seal rings are disposed in the grooves, and the upper ribs mate with corresponding lower ribs with the seal rings interposed therebetween for forming seals.

6. A washing machine according to claim 3, wherein a liquid is contained in chambers formed between adjacent ones of the ribs.

7. A washing machine according to claim 6, wherein said liquid is a saline solution.

8. A washing machine according to claim 1, wherein said lower body has a plurality of ribs formed concentric to the axis and extending upward from an upper part of the lower body, and said upper body has grooves into which the ribs are fitted.

9. A washing machine according to claim 8, wherein a radially outermost groove of the upper body and a radially outermost rib of the lower body have a plurality of screw holes on their respective sides, the upper and lower bodies being joined together by screws extending through the screw holes.

10. A washing machine according to claim 8, wherein seal rings are respectively interposed between the ribs and grooves for forming seals.

11. A washing machine according to claim 8, wherein chambers are formed between adjacent ones of the ribs, a radially innermost one of the chambers being the narrowest of the chambers, and the radially outermost chamber being the widest of the chambers.

12. A washing machine according to claim 11, wherein the spaces contain a liquid.

13. A washing machine according to claim 12, wherein said liquid is an oil.

14. A washing machine according to claim 13, wherein a plurality of balls are movably located in the respective chambers containing the oil, the balls located in the radially innermost chamber being smaller than the balls located in the radially outermost chamber.

* * * * *